United States Patent [19]

Aita et al.

[11] Patent Number: 4,848,366

[45] Date of Patent: Jul. 18, 1989

[54] EXHAUST MASK SYSTEM AND DEVICE

[75] Inventors: Anthony Aita, Philadelphia; H. Warren Goldman, Merion, both of Pa.

[73] Assignee: Cybernetic Systems, Inc., Philadelphia, Pa.

[21] Appl. No.: 895,775

[22] Filed: Aug. 12, 1986

[51] Int. Cl.[4] ..... A61B 19/00

[52] U.S. Cl. ..... 128/863; 128/266.21; 128/266.28; 128/910

[58] Field of Search ..... 160/139, 206.28, 265.29, 160/205.21, 206.19, 206.21, 910, 201.15, 205.12, 205.19; 2/171.3

[56] References Cited

U.S. PATENT DOCUMENTS

| | | | |
|---|---|---|---|
| 1,463,390 | 7/1923 | Fernandes | 128/139 |
| 2,376,871 | 5/1945 | Fink | 128/206.28 |
| 3,130,722 | 4/1964 | Dempsey et al. . | |
| 3,247,599 | 7/1975 | Malmin | 128/139 |
| 3,288,138 | 11/1966 | Sachs | 128/137 |
| 3,315,672 | 4/1967 | Cunningham et al. | 128/139 |
| 3,625,207 | 12/1971 | Agnew | 128/139 |
| 3,804,086 | 4/1974 | Agnew | 128/206.25 |
| 3,827,433 | 8/1974 | Shannon . | |
| 3,955,570 | 5/1976 | Hutter, III . | |
| 4,019,508 | 4/1977 | Der Estephanian et al. . | |
| 4,055,173 | 10/1977 | Knab . | |
| 4,150,443 | 4/1979 | McNeilly | 2/436 |
| 4,583,535 | 4/1986 | Saffo | 128/201.25 |
| 4,589,408 | 5/1986 | Singer | 128/132 R |
| 4,606,341 | 8/1986 | Hubbard et al. | 128/206.19 |
| 4,635,628 | 1/1987 | Hubbard et al. | 128/201.17 |
| 4,641,645 | 2/1987 | Tayebi | 128/206.19 |
| 4,643,182 | 2/1987 | Klein | 128/210.25 |
| 4,662,005 | 5/1987 | Grier-Idris . | |
| 4,672,968 | 6/1987 | Lenox et al. | 128/380 |
| 4,673,084 | 6/1987 | Hubbard et al. | 206/438 |
| 4,688,566 | 8/1987 | Boyce | 128/206.19 |
| 4,701,965 | 10/1987 | Landis | 2/428 |
| 4,702,240 | 10/1987 | Chaoui | 128/204.18 |
| 4,711,539 | 12/1987 | Krusas et al. | 351/63 |

FOREIGN PATENT DOCUMENTS 556664 12/1974 Sweden .

*Primary Examiner*—Max Hindenburg
*Assistant Examiner*—K. M. Reichle
*Attorney, Agent, or Firm*—Panitch, Schwarze, Jacobs and Nadel

[57] ABSTRACT

A mask system and device for an individual including a front portion defining a surface which is generally C-shaped and preferably forms bights or curved surfaces in both the horizontal and vertical cross section. The surface extends from and conforms to a position below the eyes to an area below the chin. The mask also includes sides integrally formed with the front portion and positioned adjacent the cheeks or jaw. The surface, in part, defines a cavity between the sides adjacent the individual's nose and mouth. An exhaust device is affixed to a defined channel formed on one lateral side. The opposite lateral side forms an intake port. Securing straps are provided to retain the mask portion adjacent the face. The exhaust device is provided at the free end of a tube which communicates with the side channel to create a continuous air flow across the cavity and to exhaust stale exhaled air.

12 Claims, 3 Drawing Sheets

EXHAUST MASK SYSTEM AND DEVICE

FIELD OF THE INVENTION

This invention is directed to a mask having an exhaust device to remove exhaled stale air from within the mask.

BACKGROUND OF THE INVENTION

Heretofore respiratory masks having exhaust devices attached thereto have been known. For example, see U.S. Pat. Nos. 3,130,722; 3,955,570; 4,019,508; and 4,055,173 and Swiss Pat. No. 556,664.

The prior art mask devices typically cover the wearer's entire face. See U.S. Pat. Nos. 3,955,570; 4,019,508; and 4,055,173 and Swiss Pat. No. 556,664.

U.S. Pat. No. 3,130,722 is directed to a respiratory mask which does not cover the entire face of the wearer. The mask shown in this patent includes an apex which is generally formed over the wearer's nose. The apex of the mask is generally V-shaped in both the horizontal and vertical cross-sections and positioned directly above the nose. The mask also includes a port which allows ambient air to pass through the mask and into a cavity defined by the apex of the mask over the wearer's face.

SUMMARY OF THE INVENTION

The subject invention is directed to a lightweight, easy-to-use, comfortable mask and exhaust device for use by surgeons, nurses, dentists or other personnel who utilize face mask type protection within the normal working environment. The subject invention is an improvement over the bulky "helmet" or "full face" type device as discussed above. The invention is designed to promote flow of exhaled stale air from the mask. Additionally, the subject invention cannot "fog up" because it does no cover the eyes of the wearer and because it restricts moisture laden air from exhausting toward eye glasses or the like.

The present invention is directed to a exhaust system or device for an individual. The system includes a mask defining a front surface which generally covers the wearer's nose and mouth. The front surface of the mask is generally C-shaped in a horizontal section and forms a first bight or curved surface. The front surface is also generally C-shaped in a vertical cross section and forms a second bight. The first and second bights are in proximity to one another. The mask including the front surface extends from below the individual's eyes to an area below the individual's chin and is adjustable about these positions. The mask also includes laterally extending portions or sides which generally extend from the front surface and are positioned adjacent the wearer's cheeks and jawbone. The bights of the front surface, in part, define a cavity between the sides of the mask and in front of the nose and mouth. Defined ports or channels are provided in both sides of the mask and generally form a passageway from one side, through the cavity and the opposite side. Means are generally provided for securing the mask to the individual and preferably attach the mask in a similar manner as known cloth or fiberous surgical masks.

An exhaust device may be affixed to the port on one side of the mask to draw air through the cavity and remove stale exhaled air. The other side of the mask generally forms an intake port so as to create a cross flow of air through the cavity. An exhaust tube may be provided which extends from the exhaust side of the mask to a position over the wearer's shoulder. The exhaust device will be attached at the end of the exhaust tube. The mask and exhaust tube are preferably an impervious material although restrictive porous materials, such as a fiberous paper, may be utilized and are contemplated for both the mask and the tube.

The exhaust device of the present invention preferably comprises a fan blade mounted on a shaft within a housing and powered by an electric motor. The electric motor is, preferably, operatively coupled to battery power supply by a low battery power sensor circuit. A switch may be provided in the circuit between the battery and motor. The exhaust device is affixed to the free end of the exhaust tube or directly to the side of the mask to draw air through the intake port and cavity and exhaust stale exhaled air from the mask.

A device made in conformance with the teaching of the invention has been found to remove up to at least 70 to 75% of the stale air exhausted from the individual and output it through the exhaust tube.

DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
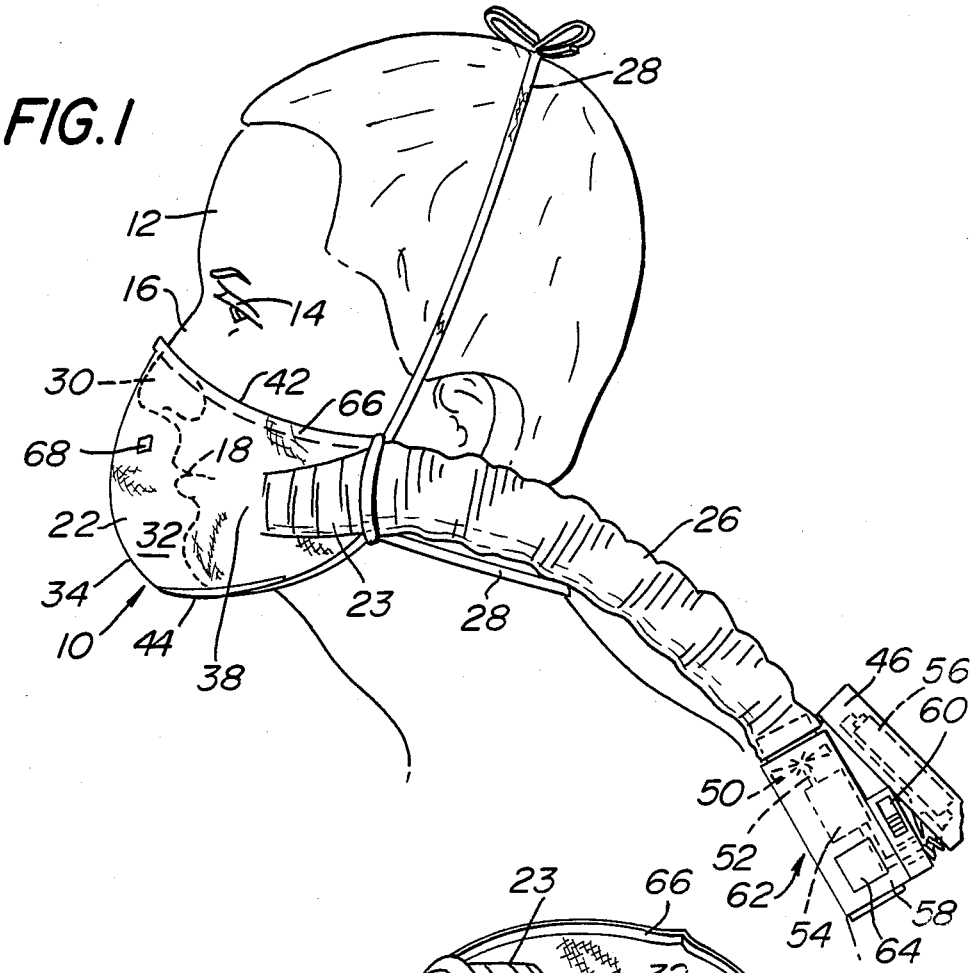
FIG. 1 is an elevational view of an embodiment of the present invention.
Figure 2:
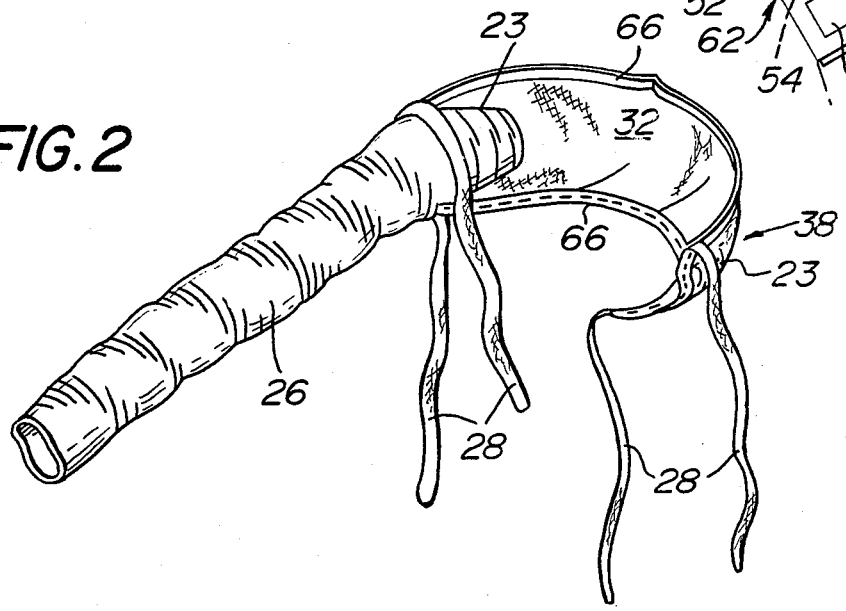
FIG. 2 is an isometric view of the present invention.

Referring to the drawings wherein like numerals identify like elements, there is shown in FIG. 1 a representation of a preferred embodiment generally designated as 10. The mask 10 includes a front portion 22, a tube 26, and an exhaust device 62. The mask 10 is secured to a head 12 preferably by straps 28 although any means may be utilized for securing the mask 10 as desired. Straps 28 are attached to the mask 10 and will secure the mask in a similar manner as a typical cloth or fiberous surgical mask as presently utilized in the art.

Figures 3, 4:
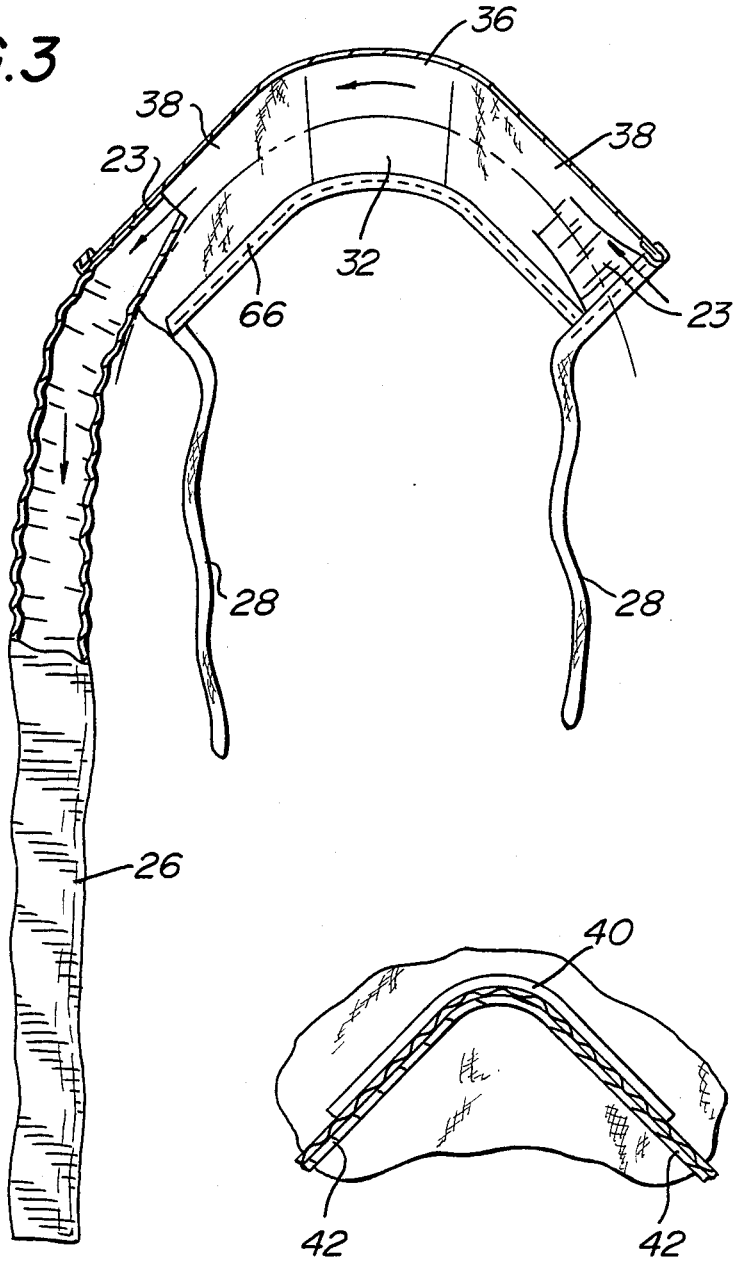
FIG. 3 is a top plan view of the present invention, portions being broken away for clarity.
FIG. 4 is a sectional plan view of a portion of the preferred embodiment of the present invention.

The front portion 22 of the mask 10 is generally C-shaped in horizontal cross-section and forms a horizontal bight 36 (see FIG. 3). The front portion 22 is also generally C-shaped in the vertical cross-section and forms a vertical or second bight 34. The horizontal and vertical bights 36 and 34 are in proximity to one another and generally form a curved surface which projects forward from the remainder of the mask portions.

Figure 5:
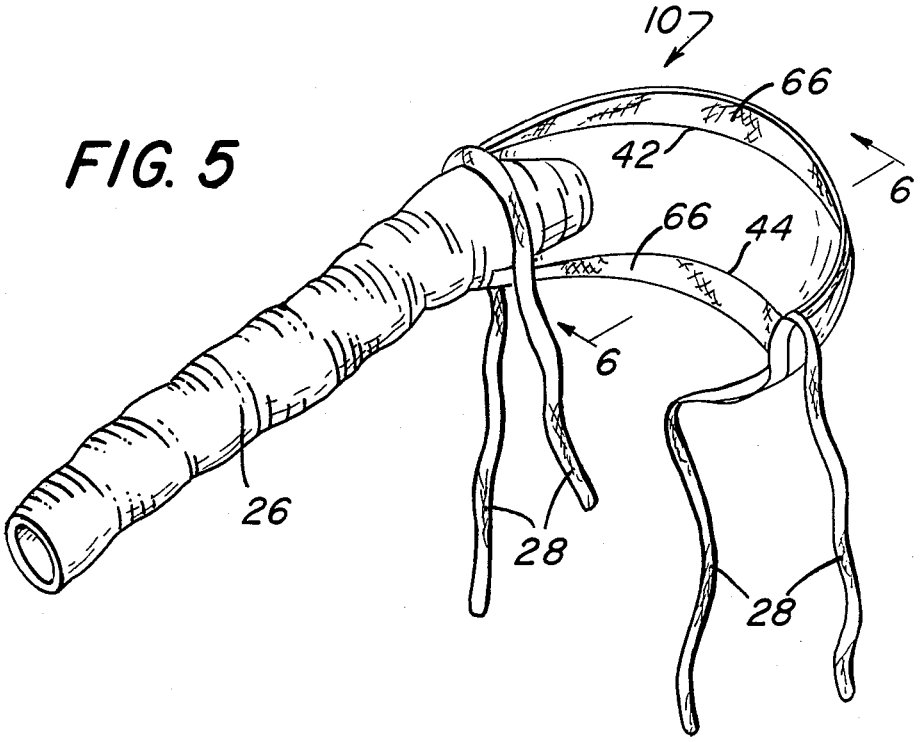
FIG. 5 is a rear elevational view of an alternate embodiment of the present invention.
Figure 6:
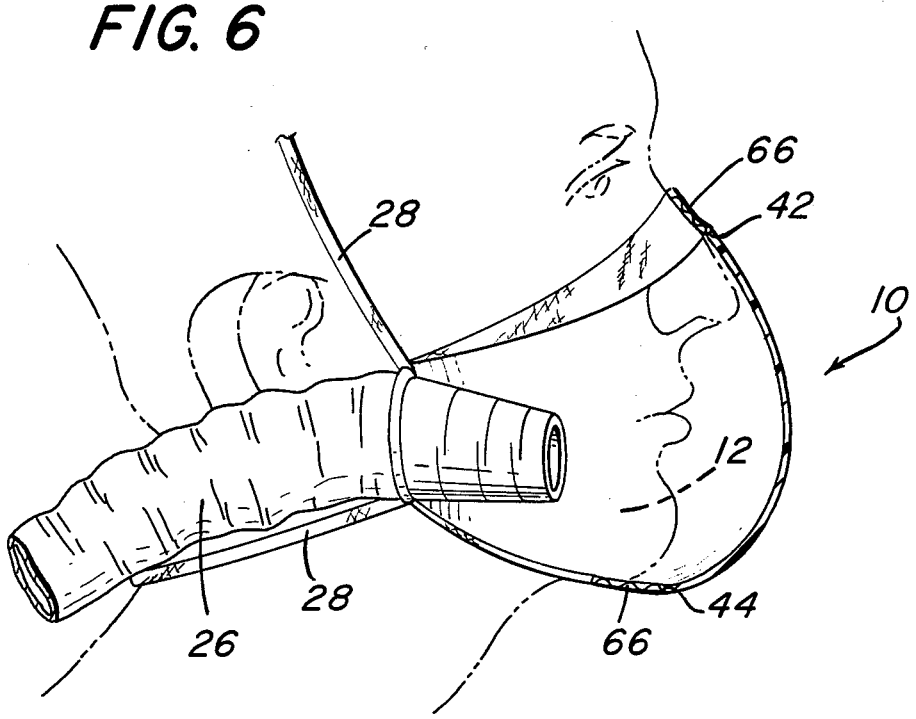
FIG. 6 is a cross-sectional view of the mask embodiment of FIG. 5 showing the wearer's face in phantom.

The mask 10 is positioned on the face from a position below the eyes 14 to an area below the chin 20. A top edge 42 of the front portion 22 is located below the eyes and generally conforms to the contours of the face when the mask is worn. A bottom edge 44 of the mask 10 is located below the chin and also conforms to the contours of the chin and/or the neck when the mask is worn. The top edge 42 and bottom edge 44 of the mask portion can be covered by an edging material 66. This edging 66 may be of a spongy foam material so as to comfortably conform to the face and chin while restricting air flow around the edges of the mask 10. Additionally, as shown in FIGS. 5 and 6, the edging 66 may also be of a cloth, fiberous or paper material which is attached to the edges 42, 44 and is self-conforming on the individual to position the mask 10 on the face 12 and restrict air flow around these edges 42 and 44. As shown in FIG. 4, a stay 40 may be preferably placed adjacent to top edge 42 of the mask 10. The stay 40 is positioned across the bridge of the nose 16 and can be shaped to follow the contours of the nose 16. The stay 40 ensures a snug fit of the top edge 42 of the mask 10 across the bridge of the nose 16. The stay 40 is secured to mask portion 22 in any conventional manner.

Lateral extensions or sides 38 are provided on the mask 10 and extend generally, from the bights 36 and 34 and surface 22 adjacent the cheeks and further define cavity 32 between the mask 10 and the face 12. The mask 10 is preferably formed to be adaptable to any individual's face by adjustment over the bridge of the nose 16 and under the chin 20 of the position of the top edge 42 and bottom edge 44. Adjustment may be made by setting the device 10 at various positions by what appears to be a pivoting of the sides 38 off of the cheeks and or jaw bone. The cavity 32 is formed between the bights 36, 34 of the front portion 22 and the mouth 18 and nose 14. The front portion 22, preferably, encloses the nose 16 and mouth 18 such that the cavity 32 is formed regardless of the adjusted position of the mask 10 on the face.

A channel or port 23 is, preferably, formed on both sides 38 of the mask 10 with each communicating with cavity 32. An exhaust tube 26 may be affixed to one side 38 of a mask portion 22 within the defined channel 23. Exhaust tube 26 is secured to the mask 10 in any conventional manner which preferably limits the escape of air or exhaust into or out of the mask 10 around the edges or sides. The tube 26 is preferably made of a flexible and light weight material for maximum comfort and ease of positioning so as to not obstruct the individual's vision or mobility during use of the mask 10. SMOOTH-BOR (Registered TM) type flexible corrugated tubing as manufactured by the Smooth-bor Plastics Company of California is particularly useful since this type tubing is extremely flexible and light weight and contains no internal ridges which may cause restriction to the air flow through the tubing 26. It is desired that the flow path from the channel 23 forming the intake port, through the cavity 32 and the tubing 26 be well defined and include minimal flow restrictions. The substantially unrestricted flow path will improve exhaustion of exhaled air through the exhaust end of the mask and not around the edges and will greatly reduce the power requirements of the exhaust device 62 (discussed below). Tube 26 extends from the lateral side 38 of the mask portion 22 to an area generally behind head 12. Since the tube 26 is preferably flexible, it can be placed in most any position and will not form a restriction to movement of the head or the individual. Additionally, the tube 26 may be positioned one either side 38 of the mask 10 in either or both of the channels 23, depending on the desires of the individual.

The tube 26 can be mated with an exhaust device 62 having means to secure the device 62 to the tube end 47. The exhaust device 62 includes a housing 58 having an internal fan blade 50, secured to a shaft 52 which is powered of an electrical motor 54. Motor 54 is operatively connected to a battery type power supply 56 within a retainer 46. A switch 60 is conventionally provided between the batteries 56 and the motor 50. The exhaust device 62 can be secured to the clothing in the area of the wearer's back or shoulder for support and, because of the contemplated light weight nature, will not require additional harnesses or the like to secure the unit 62. The exhaust device 62 may also be mounted directly to the mask 10 at a channel 23 on side 38 without requiring connection with a tube 26 from the mask 10.

In operation, exhaust device 62 continuously circulates air through cavity 32. Air is drawn into the mask 10 from an intake port which is defined by the channel 23 on one side 38. The intake air is drawn through the cavity 32, across the nose and mouth of the individual 12, out of the opposite channel 23 and down through the tube 26 (if provided), removing exhaled stale air along with the flow. (See the arrows in FIG. 3). The mask 10 preferably defines a continuous cross-flow of air through the cavity area 32 and permits minimal exhaust around its edges.

The mask 10 and tube 26 are preferably made of an impervious material. The mask 10 may be a flexible plastic, preferably, a rigid (i.e., substantially self-supporting of stiff while having some elastic properties) vinyl type which is opaque. A clear mask material however would allow the wearer's mouth and nose to be seen when in use. In another embodiment, the mask portion and/or the tube are formed of fiberous, paper or cloth material which may include a light film or coating on its surfaces. However, it is preferred that the front portion 22 and channels 23 be defined and stiff so as to promote flow of air between the face and the mask through cavity 32. A stiffening to help from or define the cavity 32 away from the mouth 18 and nose 14 and further the defined channels 23 in their desired shape. This stiffening agent will likely also effect the porousity of the material. Either embodiment maybe disposable as desired. The interior of the mask 10 and tube 26 may also be sprayed with a typical hospital type disinfectant which may include a bacteriacide.

In the embodiment shown in FIG. 1 the clamp or securing of the exhaust device 62 to the free end 42 of tube 26 is created by the clamping action of battery retainer 46 and housing 58, although any type clamping mechanism may be utilized. Additionally, circuit means 64 may be provided to detect a low battery power being available to the motor 54. Such means 64 may include a sensor which is either audible or causes a vibrational sensation to the wearer so that the batteries 56 may be replaced and sufficient air flow through the cavity 32 is maintained. Such circuits are commonly known and do not form a portion of the present invention.

The present invention may be embodied in other specific forms without departing from the spirit or essential attributes thereof and, accordingly, reference should be made to the appended claims, rather than to the foregoing specification, as indicating the scope of the invention.

We claim:

1. A mask for an individual consisting essentially of: a stiff air-impervious front portion adapted to substantially conform along its top and bottom edges to the surface of a wearer's face at a position below the eyes and below the chin, respectively, and to cover the nose and mouth, said front portion defining a cavity adapted to be positioned in front of the wearer's nose and mouth; bilateral side portions integral with said front portion and defining side channels adapted to extend along both sides of the individual's jaws, respectively, said channels communicating with the cavity at a position adapted to be adjacent the mouth and nose, the cavity and channels formed by the mask defining a continuous open passage adapted to pass a wearer's nose and mouth; means for securing the mask to the wearer; and means for creating a continuous cross flow of ambient air through the passage, from one side channel, across the cavity and out of the other side channel whereby the cross flow of air through the continuous passage removes exhaust gases in the area of the mouth and nose and prevents exhaust contamination being directed forward of the face.

2. The mask according to claim 1 further comprising: an exhaust tube affixed to one of the side portions at one end and communicating with the cavity via the channel therein, and the air cross flow creation means being attached to the opposite end of the tube for drawing air through the tube and the passage.

3. The mask according to claim 2 wherein the tube is made of a flexible, light-weight corrugated material.

4. A mask according to claim 2 wherein the exhaust tube is made of a flexible plastic.

5. The mask according to claim 1 wherein said air cross flow creation means further comprises an electric motor, a battery power supply, a motor operatively connected to the power supply and a fan operatively connected to said motor, the motor and fan adapted to draw air through the one side channel and the cavity the other channel

6. A mask according to claim 5 further comprising means to detect and indicate lower battery power being available to the motor.

7. The mask according to claim 1 further comprising means attached to the edges of the front and side portions of the mask adapted to contour with the face upon attachment by the securing means to the wearer.

8. The mask according to claim 7 wherein the edging means comprises a fiberous material that restricts air passage.

9. A surgical mask consisting essentially of: a surface having a generally C-shaped horizontal and vertical cross-section adapted to cover the nose and mouth and to define a cavity therebetween and including bilateral side portions each forming a channel along each side of the mask in open communication with said cavity, whereby the surface defines an interior passageway comprising the channels and the cavity, one of said channels forming an exhaust port and the other of said channels forming an inlet port for ambient air; and exhaust tube connected at one end to said exhaust port; means for securing the mask to the wearer's face; and means for drawing a continuous cross flow of air through the interior passageway, said air drawing means being mounted to an end of the tube opposite that connected to the exhaust port, said surface and said exhaust tube being made of a substantially air impervious material, whereby creating continuous flow from the inlet port, across the cavity and through the exhaust tube removes exhaled stale air from within the cavity and prevents contamination being directed forward of the wearer's face.

10. A mask as claimed in claim 9, further comprising porous edging means attached to the top and bottom edges of said surface and adapted to substantially self-conform to the wearer's face and to restrict air flow around the edges when said mask is secured to the wearer by said securing means.

11. A mask for an individual comprising: a stiff air impervious front portion adapted to cover the nose and mouth of an individual and to define a cavity forward thereof; two side portions integral with the front portion and adapted to extend adjacent the individual's cheeks or jaw, said side portions defining channels which communicate with the cavity, the cavity and channels defining a substantially continuous passageway through the mask; means for securing the mask to an individual; means for creating a continuous flow of air across the cavity from one said channel toward the other channel, said cross flow means being attached to one of the side portions for drawing ambient air into the channel formed by the other side portion, across the cavity, and removing exhaled gases from said cavity through said one channel; and edging means attached to the top and bottom edges of said front portion and adapted to substantially self-conform to the individual's face and to restrict air flow around the edges of the mask upon attachment of the mask to the individual by said securing means.

12. A mask as claimed in claim 11 wherein the edging means is made of either a cloth, fibrous or paper material.

* * * * *